United States Patent [19]

Sato

[11] 4,410,772

[45] Oct. 18, 1983

[54] SUPERMINIATURE MICROPHONE DEVICE

[75] Inventor: Masanobu Sato, Hachioji, Japan

[73] Assignee: Olympus Optical Company Limited, Tokyo, Japan

[21] Appl. No.: 370,117

[22] Filed: Apr. 20, 1982

[30] Foreign Application Priority Data

Apr. 23, 1981 [JP] Japan ..... 56/58928[U]
Apr. 23, 1981 [JP] Japan ..... 56/58929[U]

[51] Int. Cl.[3] ..... H04R 23/00

[52] U.S. Cl. ..... 179/157; 179/121 R; 339/248 S; 339/248 R; 381/87

[58] Field of Search ..... 179/157, 1 PC, 121 R, 179/140, 178, 179, 111 E, 186, 1 M, 107 R, 141; D14/12; 181/137, 141; 63/1 R; 24/13, 3 R; 339/95 R, 100, 180, 248 S, 252 R, 252 S

[56] References Cited

U.S. PATENT DOCUMENTS 2,673,898 3/1954 Reichert ..... 179/107 R 3,864,531 2/1975 Watson ..... 179/111 E X

*Primary Examiner*—G. Z. Rubinson
*Assistant Examiner*—Danita R. Byrd
*Attorney, Agent, or Firm*—Toren, McGeady and Stanger

[57] ABSTRACT

A superminiature microphone device includes a hollow body in the form of a decorative clothing accessory, a microphone unit including lead wires within the body, and a plug connected by the lead wires to the microphone unit wherein the plug has at least one pin-shaped terminal. A cord connector including a conical collet chuck is arranged to receive the pin-shaped terminal of the microphone unit plug from behind an article of clothing such as a necktie. A clamp member is arranged around the tip portion of the chuck for clamping the chuck about the plug terminal in response to a spring force. Accordingly, an electric cord can be routed from the connector behind the article of clothing so as to connect the microphone unit with an outside device so that the wearer's appearance is not affected by the presence of the connection cord.

3 Claims, 6 Drawing Figures

SUPERMINIATURE MICROPHONE DEVICE

BACKGROUND OF THE INVENTION

The present invention relates to a superminiature microphone device in which a microphone unit is incorporated in an accessary for clothes.

Nowadays, there has been developed a microphone device of a necktie pin type in which a superminiature microphone unit is fixed to a clip, with which a collar of clothes or a necktie is clasped. This microphone device has disadvantages, in that since an electric cord of the microphone unit appears on the surface thereof if the microphone unit is attached to the necktie, the cord hangs down resulting in difficulty in handling of the cord and the possibility of the user looking careless about his or her personal appearance.

SUMMARY OF THE INVENTION

It is an object of the present invention to overcome the above described disadvantages of the conventional superminiature microphone device.

It is another object of the present invention to provide a superminiature microphone device in which an accessory body incorporating a microphone unit therein is provided with a plug having an external thread portion for coupling which is threaded into an electric cord connector having an internal thread portion so as to obtain electrical connection, so that an electric cord of the microphone unit can easily be dealt with and a person appears careful about his or her personal appearance.

It is a further object of the present invention to provide a superminiature microphone device in which an accessory body incorporating a microphone unit therein is provided with a pin-shaped plug which is inserted into an electric cord connector so as to obtain electrical connection, so that an electric cord of the microphone unit can easily be dealt with and a person appears careful about his or her personal appearance.

According to the present invention there is provided a superminiature microphone device comprising an accessory body having a decoration pattern, a microphone unit incorporated therein, a plug connected to the microphone through lead wires thereof, and an electric cord connector being connected to the plug thereby connecting the microphone unit to a power supply source through an electric cord.

The plug has an external thread portion for electrically connecting the microphone unit to the cord connector through lead wires, and the cord connector has an internal thread portion being mated with the external thread portion for electrically connecting the microphone unit to the cord connector. The plug has at least one pin-shaped terminal and the cord connector comprises a conical chuck for holding the plug, a conical clamp member for clamping the tip portion of the conical chuck, and an elastic spring provided between the conical chuck and the clamp member for continually pushing the clamp member onto the peripheral surface of the conical chuck. The plug comprises a first connection terminal 5 having at the center thereof a projected and hollow cylindrical external thread portion, a hollow cylindrical insulation member being inserted into the hollow thread portion, and a second pin connection terminal being inserted into a through-hole of the insulation member. The cord connector comprises a cylindrical casing having a bottom, a third connection terminal secured to an opening of the casing and having an internal thread portion being threaded on the external thread portion, and a fourth leaf spring connection terminal provided to the bottom of the casing and being connected to the second connection terminal of the plug.

The accessory body forms a part of a badge. The accessory body forms a part of a necktie pin. The accessory body forms a part of a brooch.

BRIEF DESCRIPTION OF THE DRAWING

These and other features and advantages of the present invention will become readily apparent from the following detailed description of one embodiment of the present invention, particularly when taken in connection with the accompanying drawings wherein like reference numerals designate like or functionally equivalent parts throughout, and wherein.

DESCRIPTION OF THE PREFERRED EMBODIMENT

Figure 1:
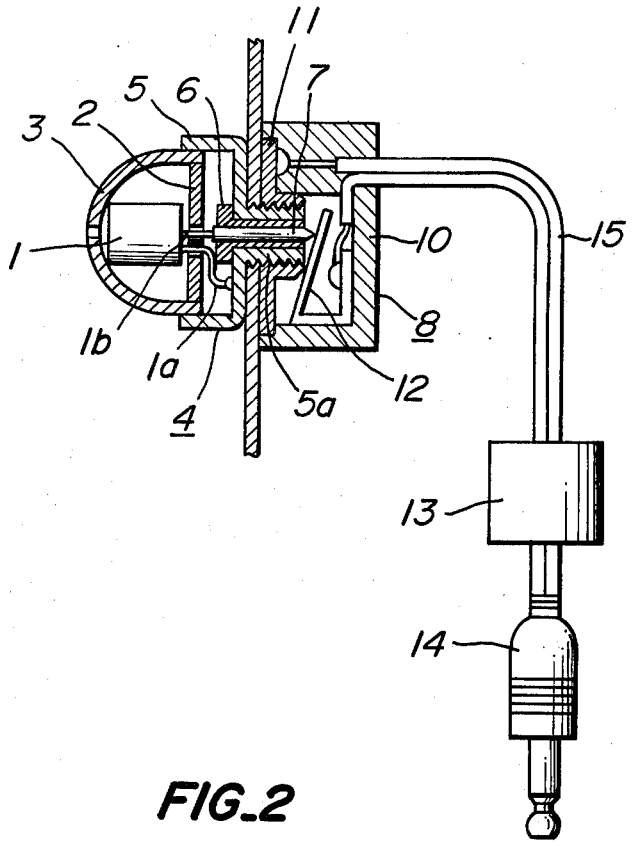
FIG. 1 is a sectional view showing a construction of one embodiment of a superminiature microphone device according to the present invention.

Referring now to the drawings, an embodiment of a superminiature microphone device according to the present invention is shown in FIG. 1.

In this embodiment the superminiature microphone device according to the present invention is applied to a badge which is fitted to a badge attaching hole formed at a collar of clothes such as a business suit.

In FIG. 1 reference numeral 1 is a superminiature microphone unit which is secured to a base plate 2. This microphone unit 1 is incorporated in an accessory body 3 of a cylinder having a bottom and formed as a badge. Lead wires 1*a*, 1*b* for the microphone unit 1 are extended through the base plate 2 and electrically connected to a plug 4 by means of soldering or the like. The plug 4 comprises a first connection terminal 5 having at the center thereof a projected and hollow cylindrical external thread portion 5*a*, a hollow cylindrical insulation member 6 being inserted into the hollow thread portion 5*a*, and a second pin connection terminal 7 being inserted into a through-hole of the insulation member 6. The first connection terminal 5 of the plug 4 is connected to the positive lead wire 1*a* of the microphone unit 1 and the second connection terminal 7 of the plug 4 is connected to the negative lead wire 1*b* of the microphone unit 1.

An electric cord connector 8 has an internal thread portion which is threaded on the external thread portion 5*a*. The cord connector 8 comprises a cylindrical casing 10 having a bottom, a third connection terminal 11 secured to an opening of the casing 10 and having an internal thread portion being threaded on the external thread portion 5*a*, and a fourth leaf spring connection terminal 12 provided to the bottom of the casing 10 and being connected to the second connection terminal 7 of the plug 4. The terminals 11 and 12 of the cord connector 8 are connected to a power supply source 13 and a microphone jack 14 through an electric cord 15.

Figure 2:
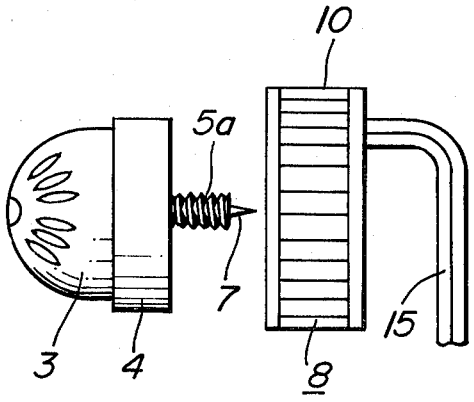
FIG. 2 is a side view of the microphone device shown in FIG. 1.

When the microphone device according to the present invention is fitted to a badge attaching hole formed at a collar of clothes such as the business suit, as shown in FIG. 2 the accessory body 3 is rotated in the predetermined direction thereby detaching it from the cord connector 8. The external thread portion 5*a* of the plug 4, then is inserted into the badge attaching hole and the thread portion 5*a* projected from the rear surface of the collar is threaded in the internal thread portion of the cord connector 8 so that the microphone unit 1 is connected to the supply source 13 and the badge incorporating the microphone 1 therein can be attached to the collar of clothes.

According to such a construction the microphone unit 1 is detachably mounted to the collar of clothes by using the plug 4 and the cord connector 8 so that the cord 15 can be led out to the rear side of the collar by threading the plug 4 in the cord connector 8 from the rear side of the collar. Therefore, the cord 15 can easily be dealt with and any person can look careful about his personal appearance.

Figure 3:
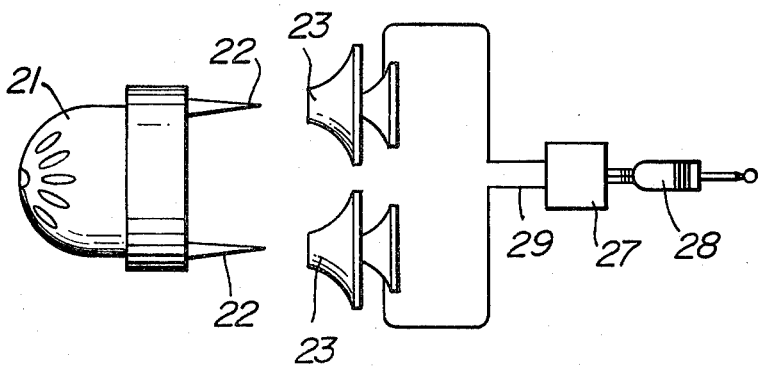
FIG. 3 is a side view showing a construction of another embodiment of a super miniature microphone device according to the present invention.
Figure 4:
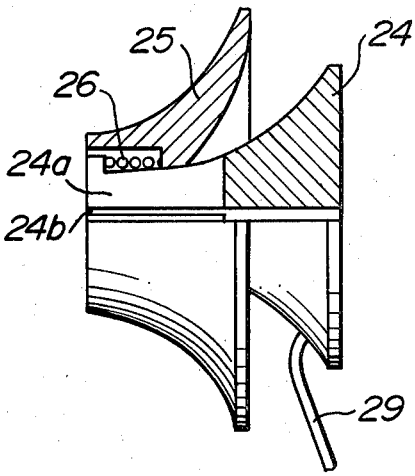
FIG. 4 is a side view, partly in cross section of an electric cord connector used in the superminiature microphone device shown in FIG. 3.
Figure 5:
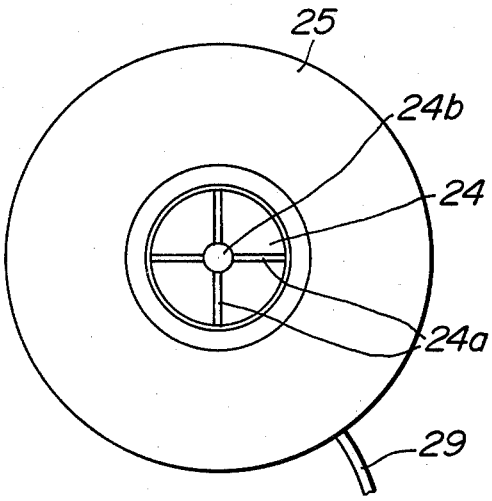
FIG. 5 is a front view of the electric cord connector shown in FIG. 4.

FIG. 3 shows another embodiment of the superminiature microphone device according to the present invention. In this embodiment the microphone device is applied to a necktie pin for clasping a necktie. In FIG. 3 reference numeral 21 is a necktie pin as an accessory body which incorporates a superminiature microphone (not shown) therein. The accessory body 21 is provided at its rear side with a pair of pin plugs 22 connected to the microphone through lead wires (not shown). The pin plugs 22 can be inserted into two electric cord connectors 23 respectively. The cord connector 23, as shown in FIG. 4, comprises a conical collet chuck 24 for holding the plug 22, a conical clamp member 25 for clamping the tip portion of the collet chuck 24, and an elastic spring 26 provided between the collet chuck 24 and the clamp member 25 for continually pushing the clamp member 25 onto the peripheral surface of the collet chuck 24. In the shown embodiment the collet chuck 24 is formed by a conductive material and the clamp member 25 is formed by an insulating material. As shown in FIG. 5 the collet chuck 24 has axial slits 24*a* cut through its tip, and at its center a through-hole 24*b* having an inner diameter slightly larger than an outer diameter of the plug 22. The two cord connectors 23 are connected to a power supply source 27 and a microphone jack 28 through an electric cord 29.

According to such a construction the plug 22 is detached from the cord connector 23, the pin plug 22 of the accessory body 21 is pierced through a necktie from its surface and the pin plug 22 projected to the rear side of the necktie and inserted into the through-hole 24*b* of the cord connector 23, so that the microphone can be attached to the necktie or the like.

Figure 6:
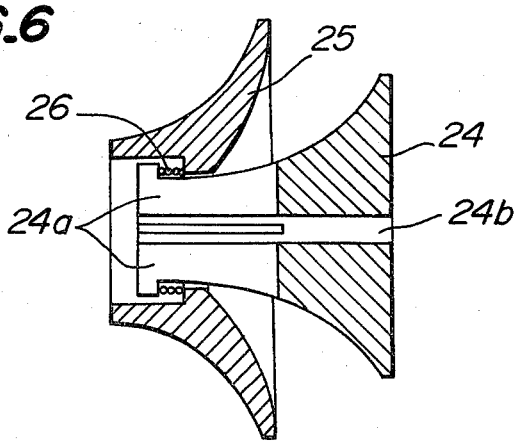
FIG. 6 is a longitudinal sectional view of the electric cord connector shown in FIG. 5.

That is, when the clamp member 25 is slid in the direction of the small diameter of the collet chuck 24 by pressing, as shown in FIG. 6, a gap is formed between the collet chuck 24 and the clip member 25 resulting in a formation of large hole 24*b*. Under such a condition the plug 22 is inserted into the hole 24*b* of the collect chuck 24, and then pressing force is released from the clamp member 25 so that the clamp member 25 is returned in the direction of large diameter of the collet chuck 24 by the biassing force of the elastic spring 26. Therefore, the collet chuck 24 is tightened by the widened surface of the collet chuck 24 and the clip member 25, so that the plug 22 is held by the collet chuck 24 and the microphone unit is connected to the supply source 27 through the plug 22 and the cord connector 23.

According to another embodiment of the present invention, the plug 22 for electrically connecting the microphone is made in the form of pin so that the microphone can be attached to the desired position of clothes without tearing materials thereof. The microphone is detachably mounted by using the plug 22 and the cord connector 23 so that the plug 22 is inserted into the cord connector 23 from the rear side of the necktie and thus the cord 29 can be led out to the rear side thereof. Therefore, the cord 29 can easily be dealt with and a person looks careful about his personal appearance.

It is further understood by those skilled in the art that the forgoing description is a preferred embodiment of the disclosed device and the present invention is not limited thereto and that various changes and modifications may be made in the present invention without departing from the spirit and scope thereof.

For example, a brooch can be used as an accessory instead of the badge or the necktie pin.

What is claimed is:

1. A superminiature microphone device comprising an accessory body having a decoration pattern, a microphone unit including lead wires incorporated in said accessory body, a plug connected to the microphone unit through said lead wires, and an electric cord connector for connection to the plug for connecting the microphone unit to a power supply source through an electric cord, wherein the plug has at least one pin-shaped terminal and the cord connector comprises a conical collet chuck having a tip portion at one end for holding the plug, a conical clamp member for clamping the tip portion of the collet chuck about the plug, and an elastic spring provided between the collet chuck and the clamp member for continually pushing the clamp member onto the peripheral surface of the collet chuck.

2. A superminiature microphone device comprising an accessory body having a decoration pattern, a microphone unit including lead wires incorporated in said accessory body, a plug connected to the microphone unit through said lead wires, and an electric cord connector for connection to the plug for connecting the microphone unit to a power supply source through an electric cord, wherein the plug comprises a first connection terminal having at the center thereof a projected and hollow cylindrical external thread portion, a hollow cylindrical insulation member inserted into the hollow thread portion, and a second pin connection terminal inserted into a through-hole of the insulation member.

3. A superminiature microphone device as claimed in claim 2, wherein the cord connector comprises a cylindrical casing having a bottom, a third connection terminal seated in an opening of the casing and having an internal thread portion for threaded engagement on the external thread portion of the first connection terminal of the plug, and a fourth leaf spring connection terminal provided on the bottom of the casing for connection to the second connection terminal of the plug.

* * * * *